US007187301B2

(12) United States Patent
Lu

(10) Patent No.: US 7,187,301 B2
(45) Date of Patent: Mar. 6, 2007

(54) TRAFFIC LIGHT PREDICTION SYSTEM

(76) Inventor: Guixian Lu, 853 Melrose Rd., Pontiac, MI (US) 48340

( * ) Notice: Subject to any disclaimer, the term of this patent is extended or adjusted under 35 U.S.C. 154(b) by 185 days.

(21) Appl. No.: 10/894,922

(22) Filed: Jul. 20, 2004

(65) Prior Publication Data

US 2006/0055557 A1 Mar. 16, 2006

(51) Int. Cl.
*G08G 1/096* (2006.01)

(52) U.S. Cl. ..... 340/929; 340/907; 340/994

(58) Field of Classification Search ..... 340/917, 340/920–930, 932, 916, 906, 911, 915, 994, 340/907

See application file for complete search history.

(56) References Cited

U.S. PATENT DOCUMENTS 5,673,039 A * 9/1997 Pietzsch et al. ..... 340/905
6,175,313 B1 * 1/2001 Berezovsky ..... 340/929
6,310,562 B1 * 10/2001 Safronov et al. ..... 340/929
6,516,273 B1 * 2/2003 Pierowicz et al. ..... 701/301
6,552,668 B1 * 4/2003 Berezovsky ..... 340/929
2002/0005790 A1 * 1/2002 Georgalis ..... 340/929
2004/0010352 A1 * 1/2004 Stromme ..... 701/1
2005/0102872 A1 * 5/2005 Seguin et al. ..... 40/601

* cited by examiner

*Primary Examiner*—Jeffery Hofsass
*Assistant Examiner*—Hoi C. Lau

(57) ABSTRACT

A traffic system that helps a driver to save gasoline by avoiding red light or by decelerating before a red light. It predicts the colors of a traffic light and informs about the future traffic light colors that will happen to a driver. The system comprising a sub-control system, three kinds of moving sections representing three future colors: green, yellow, and red. The positions of the moving sections are showed by indicators. The indicators are secured along one side of the street.

10 Claims, 2 Drawing Sheets

A Traffic Light Prediction System

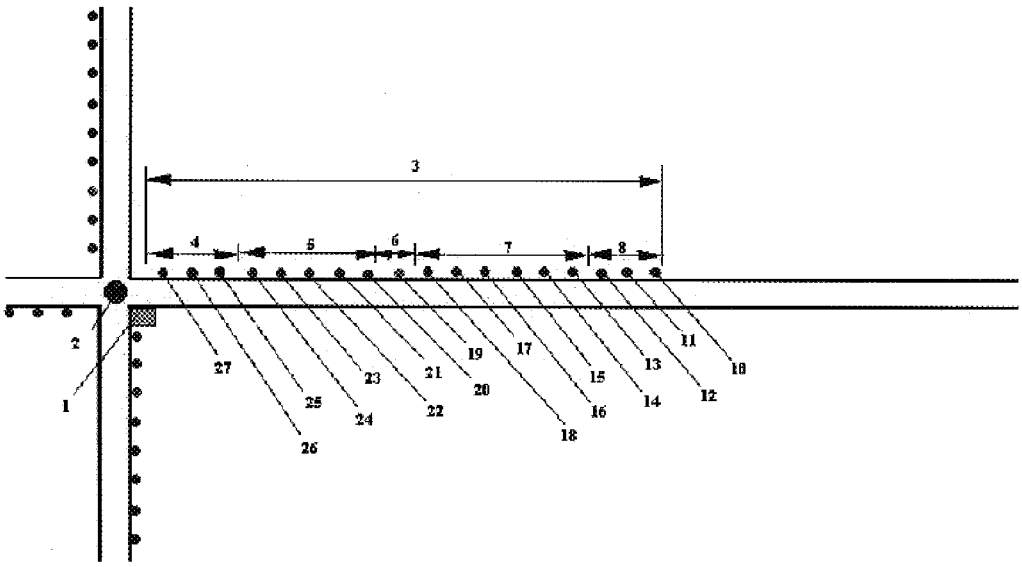
A Traffic Light Prediction System Figure 1

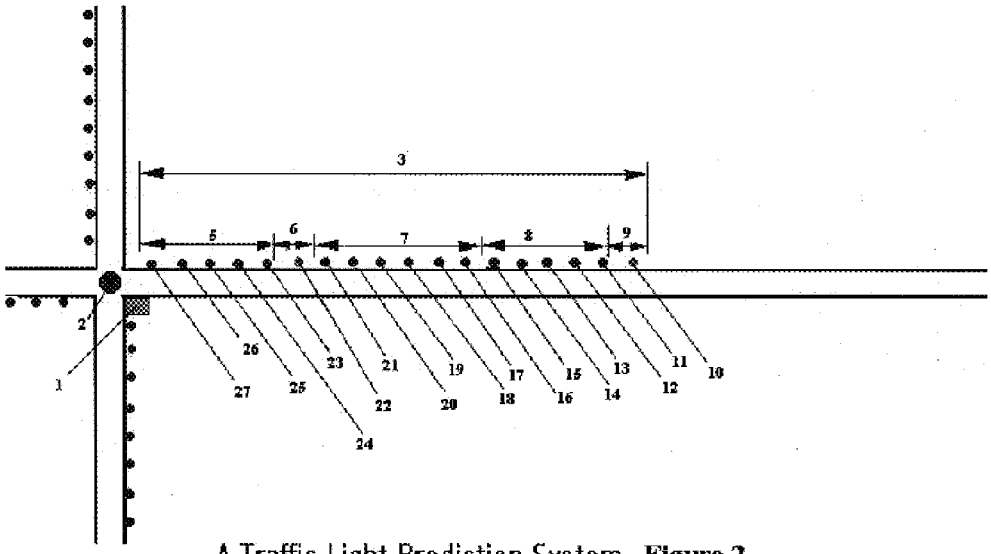
A Traffic Light Prediction System Figure 2

TRAFFIC LIGHT PREDICTION SYSTEM

BACKGROUND OF THE INVENTION

There are many traffic lights in a city. When a vehicle run into a red light, it must stop and wait until the light changes to green before it is allowed to go. This wastes fuel and causes more pollution. It wastes travel time also. That is why the hybrid vehicles are hot now, but hybrid vehicles are expensive. Hybrid vehicles lose energy in both conversion of kinetic energy to chemical energy and conversion of chemical energy to kinetic energy. Hybrid vehicles can not convert kinetic energy to chemical if the battery is fully charged.

PRIOR ART a. Berezovsky (U.S. Pat. No. 6,552,668) "Attachment to traffic light apparatus for visual indication of traffic light duration"
b. Seguin et al. (U.S. 2005/0102872) "Traffic-signaling system"
c. Berezovsky (U.S. Pat. No. 6,175,313) "Attachment to traffic light apparatus for visual indication of traffic light duration"
d. Safronov et al. (U.S. Pat. No. 6,310,562) "Method of indicating time remaining until traffic lights change"
e. Peorowicz et al. (U.S. Pat. No. 6,516,273) "Method and apparatus for determination and warning of potential violation of intersection traffic control devices"

SUMMARY OF THE INVENTION

The primary objective of the present invention is to save fuel for vehicles and travel time. Other objectives are to reduce pollution from vehicles, to maximize the usage of the streets, and to reduce traffic accidents and traffic jams.

The forgoing objectives are accomplished by defining moving sections on a street, moving towards the traffic light. Usually each kind of moving section represents one future color from the traffic light. Green sections will result in arriving to a green light. Red section will result in arriving to a red light. There are Indicators informing the drivers about the locations and colors of the moving sections. Some small lights, may act as Indicators. The drivers will know how to change the speed in order to shift from a red section to a green section.

BRIEF DESCRIPTION OF THE DRAWING

In FIG. 1:

The rectangle 1 is a control sub-system, synchronizing with the traffic light 2. The color of the traffic light 2 is red, if it is observed from control zone 3. Control zone 3 consists of a red section 4 (purple), a green section 5 (blue), a yellow section 6 (orange), a red section 7, and a green section 8. There are 18 indicators (10 to 27) secured on the side of the street in zone 3. Each indicator can be purple, blue, or orange. Indicators 10, 11, and 12 indicate the position of green section 8 by emitting blue light. Indicators 13, 14, 15, 16, 17, and 18 indicate the position of red section 7 by emitting purple light. Indicator 19 indicates the position of yellow section 6 by emitting orange light. Indicators 20, 21, 22, 23, and 24 indicate the position of green section 5. Indicators 25, 26, and 27 indicate the position of red section 4. It can be seen that the closest moving section, red section 4 (purple), represents red, which is the same color of traffic light.

In FIG. 2:

The movements of moving sections, since the moment of FIG. 1, are showed. The front edge of green section 5 has moved from the indicator 24 to 27. It has advanced towards the traffic light. The yellow section 6 has advanced from indicator 19 to 22. The front edge of red section 7 has advanced from indicator 18 to 21. The front edge of green section 8 has advantaged from indicator 12 to 15. A new yellow section 9 started at the far end of control zone 3. The positions of all indicators did not change. It can be seen that the front edge of green section 5 (full length) has just arrived at the traffic 2. Therefore, it is about the time for the traffic light 2 to change the traffic light color. It can be seen that the color of the traffic light 2, when it is observed from control zone 3, has changed to green, which is the color that green section 5 represents.

DETAILED DESCRIPTION

The present invention defines three kinds of moving section on streets before a traffic light: red sections, green sections, and yellow sections, representing three future colors of the traffic light. There is a control zone along the length of the traffic light, comprised by moving sections. Every moving section starts from the far end of the control zone, moving towards the traffic light, and ends at the traffic light. The length of the control zone (total length of moving sections) is fixed and is made long enough, if possible, to give vehicles long enough time to shift from a red section to a green section before they reach the traffic light. It is not necessary, though to make the control zone that long. Usually the speed of moving sections is lower than the speed limit on the street. Length of every moving section increases from zero since it starts at the far end of the control zone. The full length of a moving section is approximately equal to speed of moving sections multiplied by the period of the color that the moving section represents. Let's say the speed is 30 mile per hour. The green light lasts 0.5 minute. The full length of a green section should be 0.25 mile. The movement of the moving sections is synchronized with the periods of the traffic light as follows: When a green section reaches the traffic light, it is about the time for the traffic light to change the color to green. When a yellow section reaches the traffic light, it is about the time for the traffic light to change the color to yellow. When a red section reaches the traffic light it is about the time for the traffic light to change the color to red. As the result of the synchronization, the moving section close to the traffic light always represents the same color as the traffic light.

There are Indicators to inform drivers about the positions and colors of the moving sections. The Indicators may be small lights on the street. The small lights at both ends of each moving section keep changing color to show the moving of the section.

There will be a tendency of filling the green section with vehicles. Drivers at the front edge of a green section would not increase speed to get into the red section. Vehicles in side a green section would move towards the front part of the green section because most of the drivers have a tendency to drive fast. As a result, this will concentrate vehicles in the front part of green sections, empty space at the rear part of green sections. Vehicles at front edge of a red section may accelerate to the yellow section or green section. This is allowed because speed of the moving sections is under speed limit. Most of the vehicles in a red section will reduce speed to save gasoline. A vehicle reducing speed may force vehicles behind it to reduce speed. As a result, this will concentrate vehicles to the rear part of a red section or force some vehicles to shift to the green section behind it, which is good for them. The fact that vehicles concentrate to green sections means saving travel time and increase usage of streets. The fact that there are less vehicles in red sections means less traffic jams, and less traffic accidents.

There are many streets that are not long enough for vehicles to change from one moving section to another. Some of them may not be longer than one moving section. In this case, the system is still applicable. The system will benefit the drivers as follows. If the vehicles are already moving in a green section, the system will help the driver to keep moving inside the green section. If it is impossible for the vehicles to shift from a red section to a green section, decelerate as much as possible by removing foot off gasoline pedal (not by braking) before the red light. This will save on gasoline. Let's say, canceling velocity of 50 miles per hour by braking before a red light loses 4 cents of gasoline. Then canceling velocity of 25 miles per hour by braking will lose only 1 cent of gasoline, because the kinetic energy is proportional to square of velocity. The formula is $E=0.5*M*V^2$, where E is kinetic energy, M is mass, V is velocity. Decreasing fuel consumption will reduce pollution.

There is a control sub-system to control the length and movement of the moving sections. The control sub-system is synchronized with the traffic light so that the movements of moving sections are synchronized with the periods of colors at the traffic light. All the indicators are controlled by the control sub-system.

What is claim is:

1. A Traffic Light Prediction System that helps a driver to save gasoline by avoiding red lights or by decelerating before a red light comprising:

a) at least two kinds of moving sections, said moving sections are positioned at varying distances along the street extending out from the traffic light;

the length of said moving sections is related to future periods of the traffic light colors;

each said moving section represents at least one future color of the traffic light;

said moving sections have green sections, yellow sections, and red sections;

b) at least one control sub-system, said control sub-systems are used to control the positions, length, and movement of said moving sections;

c) at least on indicator, said indicators are used to indicate the positions and colors of said moving sections.

2. The Traffic Light Predication System of claim 1, wherein each kind of moving sections represents at least one color(s) of the traffic light.

3. The Traffic Light Prediction System of claim 1, wherein the full length of a moving section of a kind of said moving sections is approximately equal to the speed of movement of said kind of moving sections multiplied by the cycle period of the respective color from the traffic light that said kind of moving sections represents.

4. The Traffic Light Predication System of claim 1, wherein said moving sections are moving towards the traffic light.

5. The Traffic Light Predication System of claim 1, wherein the movement of said moving sections are synchronized with the traffic light color period so that the time that said each moving section arrives at the traffic light, is approximately the time the traffic light changes to the color that said arriving moving section represents.

6. The Traffic Light Predication System of claim 1, wherein said control sub-systems control the length, positions, and movement of said moving sections.

7. The Traffic Light Predication System of claim 1, wherein said control sub-system synchronizes with the traffic light so that the time that said each moving section arrives at the traffic light, is approximately the time the traffic light changes to a color that the arriving moving section represents.

8. The Traffic Light Predication System of claim 1, wherein said indicators inform drivers about the positions of said moving sections and the future traffic light color that said moving sections represent.

9. The Traffic Light Predication System of claim 1, wherein said indicators are communicating with said control sub-system.

10. The Traffic Light Predication System of claim 1, wherein each of said control sub-system communicates with at least one of said indicators.

* * * * *